US010504708B2

(12) United States Patent
Hartmer

(10) Patent No.: US 10,504,708 B2
(45) Date of Patent: Dec. 10, 2019

(54) STRUCTURAL ELUCIDATION OF INTACT HEAVY MOLECULES AND MOLECULAR COMPLEXES IN MASS SPECTROMETERS

(71) Applicant: Bruker Daltonik GmbH, Bremen (DE)

(72) Inventor: Ralf Hartmer, Hamburg (DE)

( * ) Notice: Subject to any disclaimer, the term of this patent is extended or adjusted under 35 U.S.C. 154(b) by 0 days.

(21) Appl. No.: 15/287,372

(22) Filed: Oct. 6, 2016

(65) Prior Publication Data

US 2017/0110302 A1 Apr. 20, 2017

(30) Foreign Application Priority Data

Oct. 16, 2015 (DE) ..... 10 2015 117 635

(51) Int. Cl.

| | |
|---|---|
| ***H01J 49/00*** | (2006.01) |
| ***H01J 49/36*** | (2006.01) |
| ***H01J 49/40*** | (2006.01) |
| ***H01J 49/42*** | (2006.01) |
| ***H01J 49/06*** | (2006.01) |

(52) U.S. Cl.

CPC ..... *H01J 49/005* (2013.01); *H01J 49/063* (2013.01); *H01J 49/36* (2013.01); *H01J 49/40* (2013.01); *H01J 49/4245* (2013.01)

(58) Field of Classification Search

None

See application file for complete search history.

(56) References Cited

U.S. PATENT DOCUMENTS

| | | | | |
|---|---|---|---|---|
| 4,234,791 A * | 11/1980 | Enke | ..... | H01J 49/005 250/281 |
| 5,245,186 A * | 9/1993 | Chait | ..... | H01J 49/165 250/281 |
| 6,166,378 A * | 12/2000 | Thomson | ..... | H01J 49/004 250/281 |
| 6,534,764 B1 * | 3/2003 | Verentchikov | ..... | H01J 49/004 250/282 |

(Continued)

FOREIGN PATENT DOCUMENTS

| | | | | |
|---|---|---|---|---|
| JP | 2006092980 A * | 4/2006 | ..... | H01J 49/02 |
| JP | 2006092980 A1 | 4/2006 | | |

(Continued)

*Primary Examiner* — Michael J Logie

(74) *Attorney, Agent, or Firm* — Benoit & Côté Inc.

(57) ABSTRACT

The invention relates to mass spectrometric analyses of heavy molecules and molecular complexes having molecular weights sometimes well above 100,000 daltons, by collision treatment in linear RF multipole collision cells. A mixture of at least one light collision gas (<40 daltons) and at least one heavy collision gas (>80 daltons) is provided in a linear RF collision cell. The heavy collision gas results in high-momentum and high-energy collisions, which leads to splitting and further fragmentation of portions of the heavy molecular (complex) ions. For this purpose, the molecular (complex) ions are axially injected into the collision cell at kinetic energies of several hundred electronvolts per charge; due to the collisions with the heavy collision gas molecules they are deflected from the axis and excited to undergo strong oscillations in the radial direction in the focusing RF field. The light collision gas serves in turn for damping these oscillations.

16 Claims, 8 Drawing Sheets

(56) References Cited

U.S. PATENT DOCUMENTS 6,630,662 B1 * 10/2003 Loboda ..... G01N 27/622 250/281
6,674,071 B2 * 1/2004 Franzen ..... H01J 49/062 250/292
6,833,544 B1 * 12/2004 Campbell ..... H01J 49/4225 250/281
7,034,292 B1 * 4/2006 Whitehouse ..... H01J 49/004 250/281
2002/0175279 A1 * 11/2002 Hager ..... H01J 49/4225 250/282
2004/0222369 A1 * 11/2004 Makarov ..... H01J 49/004 250/281
2005/0258362 A1 * 11/2005 Collings ..... H01J 49/4225 250/290
2005/0274887 A1 * 12/2005 Weiss ..... H01J 49/04 250/292
2006/0024720 A1 2/2006 McLean et al.
2007/0051886 A1 * 3/2007 Rather ..... H01J 49/0077 250/288
2007/0084998 A1 * 4/2007 Franzen ..... H01J 49/4225 250/290
2007/0085001 A1 * 4/2007 Beene ..... H01J 49/062 250/292
2008/0135747 A1 * 6/2008 Brekenfeld ..... H01J 49/005 250/283
2008/0164409 A1 * 7/2008 Schultz ..... G01N 27/622 250/282
2009/0194686 A1 * 8/2009 Guna ..... H01J 49/005 250/283
2009/0283672 A1 * 11/2009 Brekenfeld ..... H01J 49/0072 250/282
2011/0012016 A1 * 1/2011 Maier ..... C12Q 1/04 250/282
2012/0091330 A1 * 4/2012 Coon ..... H01J 49/004 250/282
2012/0228492 A1 * 9/2012 Franzen ..... H01J 49/421 250/288
2014/0027629 A1 * 1/2014 Makarov ..... H01J 49/005 250/282
2014/0312243 A1 * 10/2014 Kalinitchenko ..... H01J 49/063 250/396 R
2015/0060687 A1 * 3/2015 Kalinitchenko ..... H01J 49/061 250/396 R

FOREIGN PATENT DOCUMENTS

WO 2009094762 A1 8/2009
WO 2015025008 A1 2/2015

* cited by examiner

STRUCTURAL ELUCIDATION OF INTACT HEAVY MOLECULES AND MOLECULAR COMPLEXES IN MASS SPECTROMETERS

BACKGROUND OF THE INVENTION

Field of the Invention

The invention relates to the mass spectrometric analysis of heavy molecules, in particular heavy molecular complexes, sometimes in their natural structure, by collisionally induced fragmentation in linear radio frequency (RF) multipole collision cells, in particular quadrupole collision cells.

Description of the Related Art

Instead of the statutory "standardized atomic mass unit" (u), this document uses the unit "dalton" (Da), which in the most recent (eighth) edition in 2006 of the document "The International System of Units (SI)" of the "Bureau International des Poids et Mesures" (International Bureaus of Weights and Measures) was provided as equivalent to the atomic mass unit, in particular, as noted therein, to allow the use of the units kilodalton, millidalton, and the like.

In mass spectrometers, it is generally possible only to determine the ratio of the ion mass to the ion charge. When reference is made hereinafter to the "mass of an ion" or the "ion mass", this may also be intended to mean the ratio of the mass m to the number z of surplus positive or negative elementary charges of the ion, i.e., the elementary charge-related ("charge-related" for short) mass m/z.

A "fragment ion mass spectrum" or "daughter ion mass spectrum" is generally understood to mean a mass spectrum of the fragment ions of a selected ion species, the ion species selected for the fragmentation usually being referred to as the "parent ion".

Mass spectrometry of intact molecular complexes has proven to be a powerful tool for investigating the stoichiometry, the relationship of structure and function, and other properties of these molecular complexes. The precise mass of the parent molecular ions and the fragment ions may be used for the quality control of produced molecular complexes. The molecular complexes may be, for example, monoclonal antibodies (in particular with antibody drug conjugate, ADC), naturally occurring soluble membrane proteins, or other noncovalently bonded protein complexes.

The intact molecular complexes are often referred to as "native" molecular complexes; they have the same form as in their natural environment. The ionization of the intact molecular complexes generally takes place in electrospray ion sources, usually so-called nanospray ion sources. The molecular complexes are supplied in aqueous solution without addition of organic solvents, which would cause undesirable denaturation, for example the unfolding of a folded molecular complex. Since the intact molecular complexes are densely packed, only the outer surfaces are accessible to protonation in the plasma of the electrospray; the number of surplus protons of these ions is therefore uncommonly low, and the charge-related mass m/z is exceptionally high, in the range of several kilodaltons.

The work by A. Laganowsky et al. in "Mass spectrometry of intact membrane protein complexes," Nature Protocols, Vol. 8, No. 4, 2013, 641 provides good insight into the difficulties of such analyses. A time-of-flight mass spectrometer with orthogonal ion injection is used here, which is customarily provided with a quadrupole mass filter and a linear collision cell. The ionization takes place via so-called nanospraying, in which an aqueous solution containing detergents but no organic solvents is used. For stripping the detergent micelles (association colloids), a single heavy gas, argon or sulfur hexafluoride ($SF_6$), is used in the collision cell, whose pressure setting, however, is extremely critical. At low pressures, satisfactory removal of the micelles is not achieved, and at higher pressures the transmission of the oligomeric complexes is greatly reduced, presumably because the heavy collision gas does not bring about thermal cooling of the complex ions. However, thermal cooling is necessary in order to collect the ions close to the axis of the linear collision cell and to conduct them out of the collision cell through generally narrow diaphragms.

Even more difficult is the fragmentation of these heavy intact molecular complex ions. With a standard light collision gas such as molecular nitrogen $N_2$, there is no, or only inadequate, fragmentation; whereas, with a heavy collision gas such as $SF_6$, there is little or no thermal cooling, and therefore no, or only inadequate, collection of the molecular ions and fragment ions in the axis of the collision cell. For this reason, in the publication by X. Ma et al. ("Surface Induced Dissociation Yields Quaternary Substructure of Refractory Noncovalent Phosphorylase B and Glutamate Dehydrogenase Complexes," J. Am. Soc. Mass Spectrom. (2014) 25: 368-379), dissociation on surfaces is avoided, but this is not possible using standard commercially available mass spectrometers without complicated modifications.

In light of the preceding discussion, there is a need to modify methods for structural elucidation of heavy molecular ions and molecular complex ions in such a way that efficient fragmentation, and at the same time efficient transmission of the ions and fragments through the mass spectrometer, become possible.

SUMMARY OF THE INVENTION

The invention relates to the mass spectrometric analysis of the ions of heavy molecules, in particular heavy molecular complexes having charge-related masses m/z of greater than 2000 daltons, preferably greater than 3000 daltons, wherein the molecular weight may sometimes be well above 100,000 daltons, by collision treatment in linear radio frequency multipole collision cells. The aim is also to be able to analyze the heavy molecules and molecular complexes in their natural environment.

Within the scope of the present disclosure, molecular complexes may be, for example, monoclonal antibodies (in particular with antibody drug conjugate, ADC), naturally occurring soluble membrane proteins, or other noncovalently bonded protein complexes.

The invention proposes operation with a mixture of at least one light inert collision gas and at least one heavy inert collision gas in linear collision cells that conduct the ions in RF multipole fields. Of the multipole fields, quadrupole fields are preferred, since they ensure the best axial focusing of the ions into the axis. The heavy inert collision gas should have a molecular mass of at least approximately 80 daltons, and the light inert collision gas should have a molecular mass of approximately 40 daltons at most. Molecular complexes are generally composed of multiple partial molecules which are held together by hydrogen bridges or disulfide bridges. The heavy collision gas results in high-momentum and high-energy collisions which desirably lead to splitting of these noncovalently bonded portions of the molecular complex ions. For this purpose, the molecular complex ions are axially injected into the collision cell at kinetic energies of several hundred electronvolts per surplus charge; due to the collisions with the heavy collision gas molecules they are deflected from the axis and excited to undergo strong oscillations in the radial direction in the focusing RF field. A light collision gas is additionally introduced into the collision cell in order to damp these oscillations.

At higher injection energies, the already split molecule portions may also be further fragmented.

The chemically inert gases xenon (Xe, ≈131 Da, monoatomic), krypton (Kr, ≈83 Da, monoatomic), sulfur hexafluoride ($SF_6$, ≈146 Da, molecular), uranium hexafluoride ($UF_6$, ≈352 Da, molecular), or perfluorinated hydrocarbons such as perfluorobutane ($C_4F_{10}$, ≈238 Da, molecular), for example, may be used as heavy collision gases; in particular inert nitrogen ($N_2$, ≈28 Da, biatomic), which has particularly good damping properties, is suited as a light collision gas; however, other light gases such as the noble gases helium (He, ≈4 Da, monoatomic), neon (Ne, ≈20 Da, monoatomic), or argon (Ar, ≈40 Da, monoatomic) may also be used.

For certain applications, it may be provided to add even further gas components to the mixture of light and heavy collision gases, for example further gases which fall under the definition of a light or a heavy collision gas, or optionally even other gases which do not meet these definitions.

The work by D. J. Douglas, "Applications of Collision Dynamics in Quadrupole Mass Spectrometry," J. Am. Soc. Mass Spectrom. 1998, 9, 101-113, provides a good overview of the fundamentals of collision processes in quadrupole ion storage cells, and is hereby incorporated by reference into the present disclosure in its entirety.

BRIEF DESCRIPTION OF THE DRAWINGS

FIG. 5A is an overview spectrum, whereas FIGS. 5B and 5C show details thereof with associated mass and charge numbers (partially annotated spectra). The kinetic energy during the axial injection in the linear collision cell is 4992 electronvolts at a 208-volt acceleration voltage.

DETAILED DESCRIPTION

Figure 1:
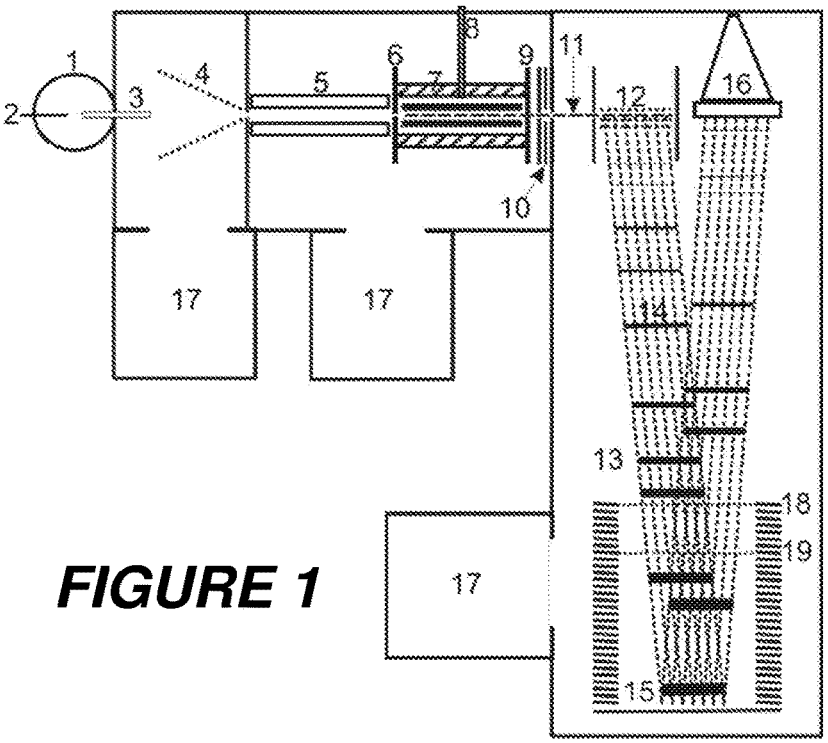
FIG. 1 shows a simplified schematic illustration of a time-of-flight mass spectrometer with orthogonal ion injection (OTOF), as is basically known in the prior art.

While the invention has been shown and described with reference to a number of different embodiments thereof, it will be recognized by those of skill in the art that various changes in form and detail may be made herein without departing from the scope of the invention as defined by the appended claims.

The invention relates to the mass spectrometric analysis of the ions of heavy molecules, in particular heavy molecular complexes, having charge-related masses m/z of greater than 2000 daltons, starting from molecular weights of sometimes well above 100,000 daltons, preferably in their natural structure, by collision treatment in linear radio frequency multipole collision cells, which preferably are made up of a number of pole rods situated in parallel, for example four pole rods for a quadrupole. The ions to be analyzed are axially injected into these collision cells at kinetic energies of up to several hundred electronvolts per surplus charge, for example 100 to 300 electronvolts multiplied by the number of surplus charges. The collision treatment may concern stripping of light particles (micelles, water complexes) which generally adhere due to hydrogen bridge formation, or may concern splitting of the molecular complexes into partial molecules, or also fragmentation of partial molecules.

A linear collision cell is typically characterized by an arrangement of a plurality of elongated electrodes (often referred to as rods) situated in parallel to one another about a common axis, such that all of the electrodes together encompass a rotational symmetry about the common axis that is larger than twofold. The electrodes may have a circular cross section. However, rods having an inwardly directed hyperbolic profile are also often used in order to generate preferably pure multipole fields. However, there are numerous other variants, such as flat electrodes, which in a pairwise oppositely situated arrangement form a polygonal inner width through the collision cell (for example, having a square cross section for a four-electrode configuration). While circular or hyperbolic electrodes may be referred to as convex embodiments, concave designs have also become known, in which the side of the electrodes facing the axis is concavely arched radially outwardly. The linearity or two-dimensionality (2D) of the collision cell means in particular that the electrodes have an axial extension or length that is a multiple of the dimensional parameter or diameter of the inner width.

The invention proposes operation with a mixture of at least one light collision gas and at least one heavy collision gas in customary linear collision cells which retain the ions using radio frequency multipole fields. The heavy collision gas should have a molecular mass of at least approximately 80 daltons, and the light collision gas should have a molecular mass of no more than approximately 40 daltons. The collision gases should have partial pressures between 0.01 and 10 pascal, with a preferred range being approximately 1 to 2 pascals for each gas. The gases may have the same partial pressure, although it often appears to be favorable when the partial pressure of the light collision gas is slightly lower than that of the heavy collision gas. The heavy collision gas may, for example, constitute 75% of the gas mixture, while the light collision gas makes up the remaining 25%.

However, there are also cases in which it is favorable for the partial pressure of the heavy collision gas to be slightly lower than that of the light collision gas. This application may be used in particular when molecular complexes that are relatively weakly bound, such as the molecular complexes of antibody drug conjugates, are analyzed. In preferred embodiments, the proportion of heavy collision gas is greater than 20%, in particular greater than 35%, particularly preferably greater than 60%, of the total collision gas in the linear collision cell. The light collision gas would then be added in complementary proportions of 80%, 65%, or 40%, respectively.

Molecular complexes are generally composed of multiple molecule parts which are held together by hydrogen bridges or disulfide bridges. The heavy collision gas results in high-momentum and high-energy collisions which desirably lead to splitting of these noncovalently bonded portions of the molecular complex ions. For this purpose, the molecular complex ions are axially injected into the collision cell at significant kinetic energies of several hundred electronvolts per surplus charge; due to the collisions with the heavy collision gas molecules they are deflected from the axis and excited to undergo strong oscillations in the radial direction. A light collision gas is additionally introduced into the collision cell in order to damp these oscillations.

Xenon (Xe, ≈131 Da), krypton (Kr, ≈83 Da), perfluorinated hydrocarbons such as perfluorobutane ($C_4F_{10}$, ≈238 Da), sulfur hexafluoride ($SF_6$, ≈146 Da), or uranium hexafluoride ($UF_6$, ≈352 Da), for example, may be used as heavy collision gases. In particular, nitrogen ($N_2$, ≈28 Da), which has particularly good damping properties, is suited as a light collision gas; however, other light gases may also be used.

Using a mixture of collision gases for specific objectives is already known, and has been used in 3D ion traps. An early example is the work by K. L. Morand et al., "Efficient Trapping and Collision-induced Dissociation of High-mass Cluster Ions Using Mixed Target Gases in the Quadrupole Ion Trap," Rapid Communications in Mass Spectrometry, Vol. 6, 520-523 (1992). The ions in 3D ion traps are generally thermally damped by helium in order to focus them spatially. In order to fragment the ions, they are excited resonantly to oscillations in the storage field by connecting specific alternating voltages at certain frequency; however, the velocities of the ions, especially the heavy ions, are not great enough to be able to absorb sufficient energy for the decomposition in collisions with helium atoms. A small portion of a heavy gas is then additionally added to improve the energy absorption, and ultimately, the decomposition into fragment ions; the authors of the above-cited work already regard the noble gases neon and argon, for example, as heavy.

Within the meaning of the present invention, these above-described mixtures of collision gases are composed of two light gases, since the mentioned gases neon and argon both have molecular masses of no more than 40 daltons.

The use of heavy, unmixed collision gases in linear collision cells is likewise known (see the above-cited work by A. Laganowsky et al.); however, there is always the drawback that it is very difficult to bring about thermal cooling of excited starting ions and fragment ions. The present disclosure differs from the earlier publications in particular by the use of a mixture of heavy and light collision gas molecules in linear collision cells, thereby solving the problem of focusing heavy ions to be collision-fragmented and their fragment ions.

The linear collision cells are regularly designed as quadrupole rod systems, and are operated with radio frequency voltages for storing and conducting the ions. The quadrupolar radio frequency field generates forces on the ions which consistently restore them into the axis of the rod system; so doing results in a pseudo-potential well around the axis in which the ions are able to radially oscillate. The injection of the ions into these linear collision cells takes place with an ion acceleration of several hundred volts. Even a single collision brings about a significant energy transfer, and usually results in splitting of a noncovalently bonded partial molecule. Statistically, however, strong lateral deflections of the remaining molecular ions also take place due to the collisions. These result in strong radial oscillations in the restoring force field, which are damped by the addition of a light collision gas. The damping causes the ions to collect once again in the axis of the system over time periods of approximately one millisecond so that they may be conducted out of the collision cell, with good focusing, to a connected mass analyzer such as a time-of-flight mass spectrometer.

Under stronger injection acceleration, for example above 200 volts, the portions of the molecule already split may also be further fragmented for additional structural elucidation.

FIG. 1 shows a simplified schematic illustration of a time-of-flight mass spectrometer with orthogonal ion injection (OTOF), as is basically known in the prior art. Ions are generated in an ion source (1) at atmospheric pressure, using a spray capillary (2), and are introduced into the vacuum system through a capillary (3). A customary RF ion funnel (4) conducts the ions into a first RF quadrupole rod system (5), which may be operated as a simple ion guide system or also as a mass filter for selecting a species of parent ions to be fragmented. The unselected or selected ions are fed continuously through the ring diaphragm (6) into the collision cell (7), which may also be used as a storage reservoir. Selected parent ions may be injected in the customary manner at fairly high injection energy, as the result of which they become fragmented due to energetic collisions with the molecules of the collision gas. The collision cell (7) is enclosed virtually gas-tight, and according to the prior art is supplied with an individual collision gas through the gas feed line (8). The radial movements of the introduced ions and also of the newly generated fragment ions are damped in the collision gas so that they collect in the axis. Ions are extracted from the collision cell (7) through the switchable extraction lens (9) in combination with the einzel lens (10), shaped into a fine primary beam (11), and sent to the ion pulser (12). The ion pulser (12) periodically pulses out a portion of the primary ion beam (11) orthogonally into the high-potential drift region (13), which is the mass-dispersive region of the time-of-flight mass spectrometer, resulting in the new ion beam (14) which contains the individual linear ion packets. The ion beam (14) is reflected in the reflector (15) with second-order energy focusing, and is detected in the detector (16).

The mass spectrometer is evacuated by the pumps (17). In the example shown, the reflector (15) represents a two-stage Mamyrin reflector having two grids (18) and (19), which enclose a first strong deceleration field, followed by a weaker reflection field. Due to the velocity spread, the linear ion packets diverge up into the reflector, but are then once again focused very finely by the velocity focusing until reaching the detector; this results in a high mass resolution, as required for the mass determination of heavy ions.

It is understood that, for the purposes of the present disclosure, the design from FIG. 1 may be used for operation with a mixture of light collision gas and heavy collision gas after appropriate modification of the collision cell (7).

Figure 2:
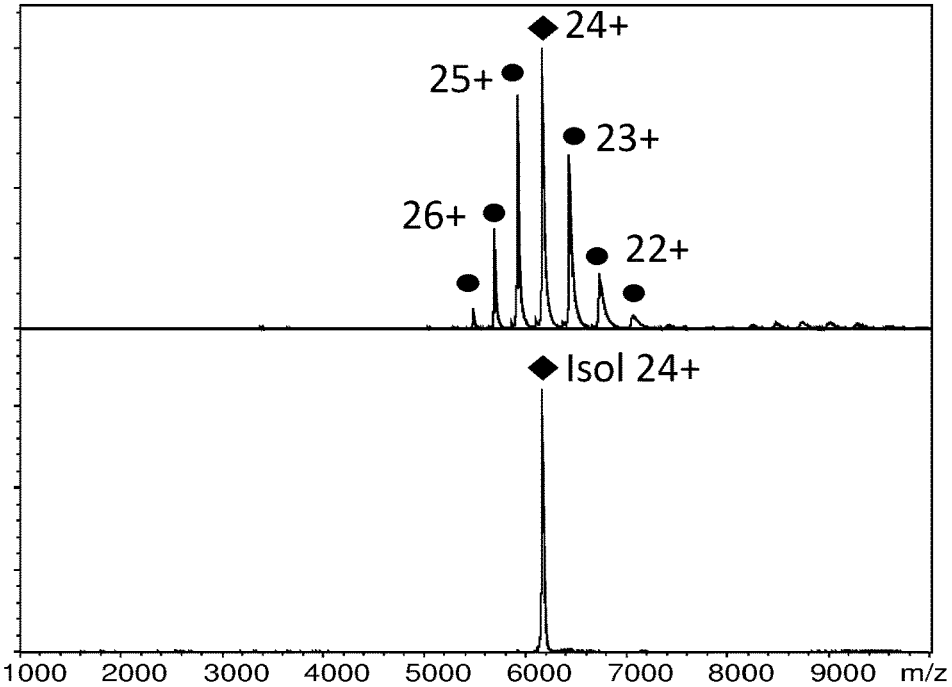
FIG. 2 at the top shows the mass spectrum of the intact antibody adalimumab (m=148,080 Da); due to its compact folding in the electrospray, few protons (approximately 21-27) are able to bind to its surface, and its ions therefore have an extremely high charge-related mass m/z of approximately 6 kilodaltons. The lower part of the figure shows the ions carrying a 24-fold charge, in isolation.

FIG. 2 shows the mass spectrum of an intact (native) antibody (adalimumab; trade name Humira®; authorization holder: AbbVie Ltd.) generated by nanospraying without addition of organic solvents. Whereas ions customarily formed by electrospraying (including nanospraying) have charge-related masses m/z in the range of 700 Da<m/z<1500 Da on account of multiple protonation, in the present case ions having masses of approximately m/z≈6000 Da are formed. An ion species can be filtered out of this distribution, using customary means (for example, a radio frequency band pass mass filter upstream from the collision cell). The lower portion of FIG. 2 illustrates the mass spectrum of the isolated ion species of the antibody containing 24 protons. This isolated ion species may now be fragmented in a linear collision cell in a mixture of nitrogen and sulfur hexafluoride.

The native sprayed adalimumab provides a distribution of charge numbers of z=21 to z=27 having little variation, and the isolated ion species containing 24 protons represents approximately 30% of the overall signal of all adalimumab ions. In the customary ESI process (using organic solvents), adalimumab provides ions with a wide range of charge numbers of z=41 to z=70. When a daughter ion spectrum of only one charge state is recorded in the customary ESI process, only a small portion of less than 10% of the overall signal is used for the daughter ion spectrum. In this regard, the native electrospraying provides for a kind of inherent charge state concentration entailing an improved mass signal basis.

For recording the daughter ion spectrum, it may be advantageous when the parent ion has comparatively few charges per mass unit. Fragmentations such as collision-induced dissociation (CID) and electron-induced dissociation, for example electron transfer dissociation (ETD), are controlled by the degree of protonation of a peptide or protein. Relationships between the charge state and charge localization in the molecule and the expected fragmentation position are known for CID and ETD. Singly charged peptides, for example, preferably exhibit dissociations at certain amino acids, in particular in the proximity of "acidic" amino acids (aspartate or glutamate) or at proline amino acids. However, if the charge number is limited by the native electrospraying, it also cannot be expected that an amide bond will be split at each site on the protein. The number of fragment ions thusly limited reduces the complexity and thus allows easier, in particular automatic, evaluation of a daughter ion spectrum under the standard requirements known to those skilled in the art. In colloquial usage, the fragment ion spectrum becomes "clearer".

Figure 3:
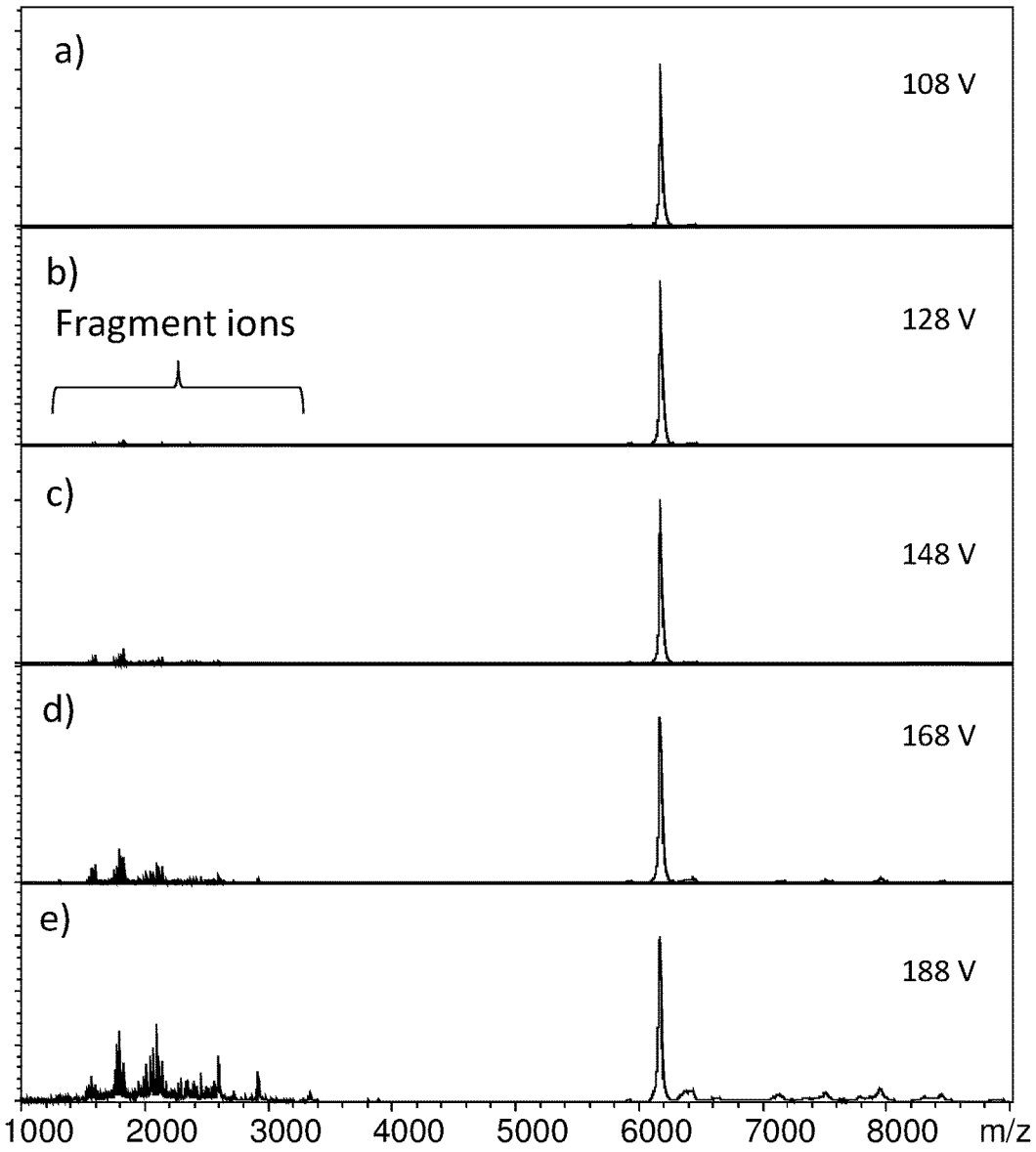
FIG. 3 depicts the mass spectra of the fragment ions of adalimumab ions carrying a 24-fold charge, which are obtained using various acceleration voltages and a collision gas mixture of nitrogen and sulfur hexafluoride. The kinetic energies during the axial injection into the linear collision cell are 2592 electronvolts at a 108-volt acceleration voltage, and 4512 electronvolts at a 188-volt acceleration voltage, respectively.
Figure 4:
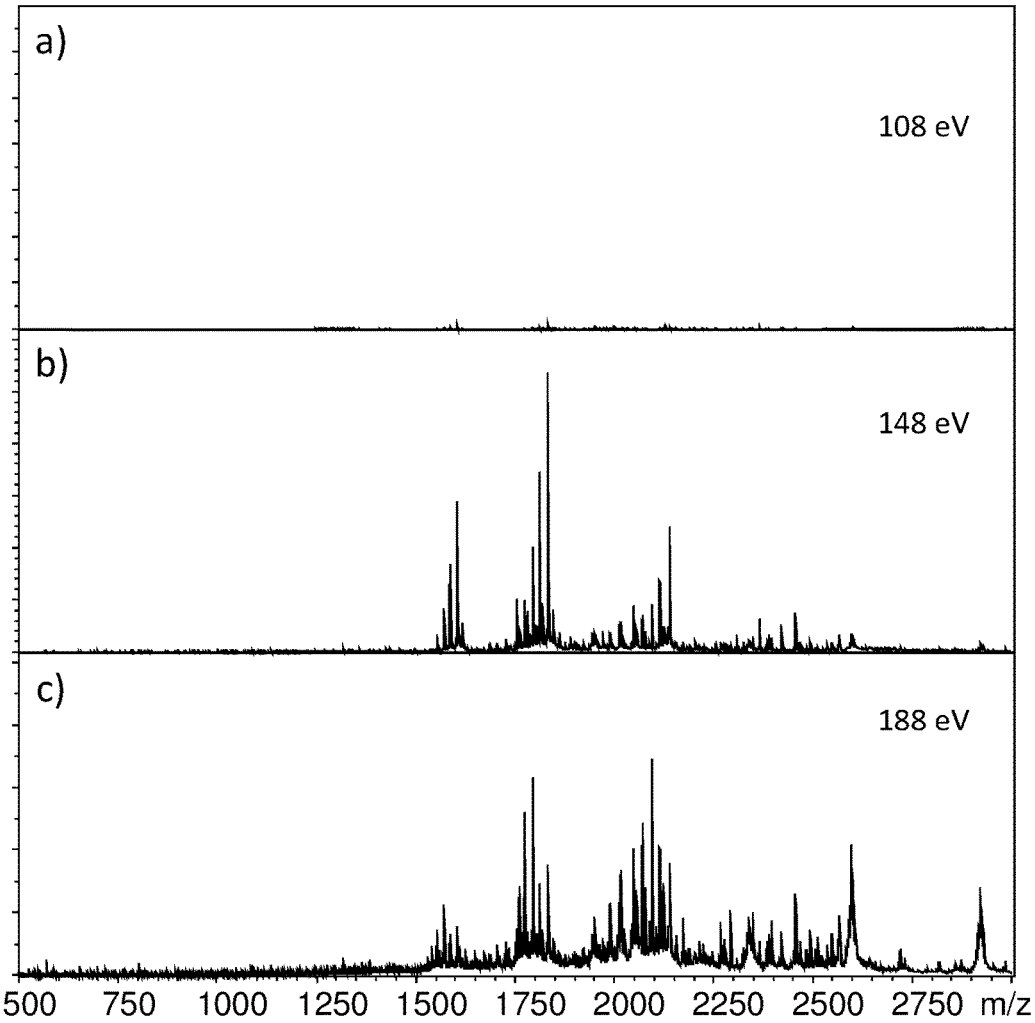
FIG. 4 illustrates an enlarged detail of the mass spectra of the fragment ions of adalimumab.
Figure 5A:
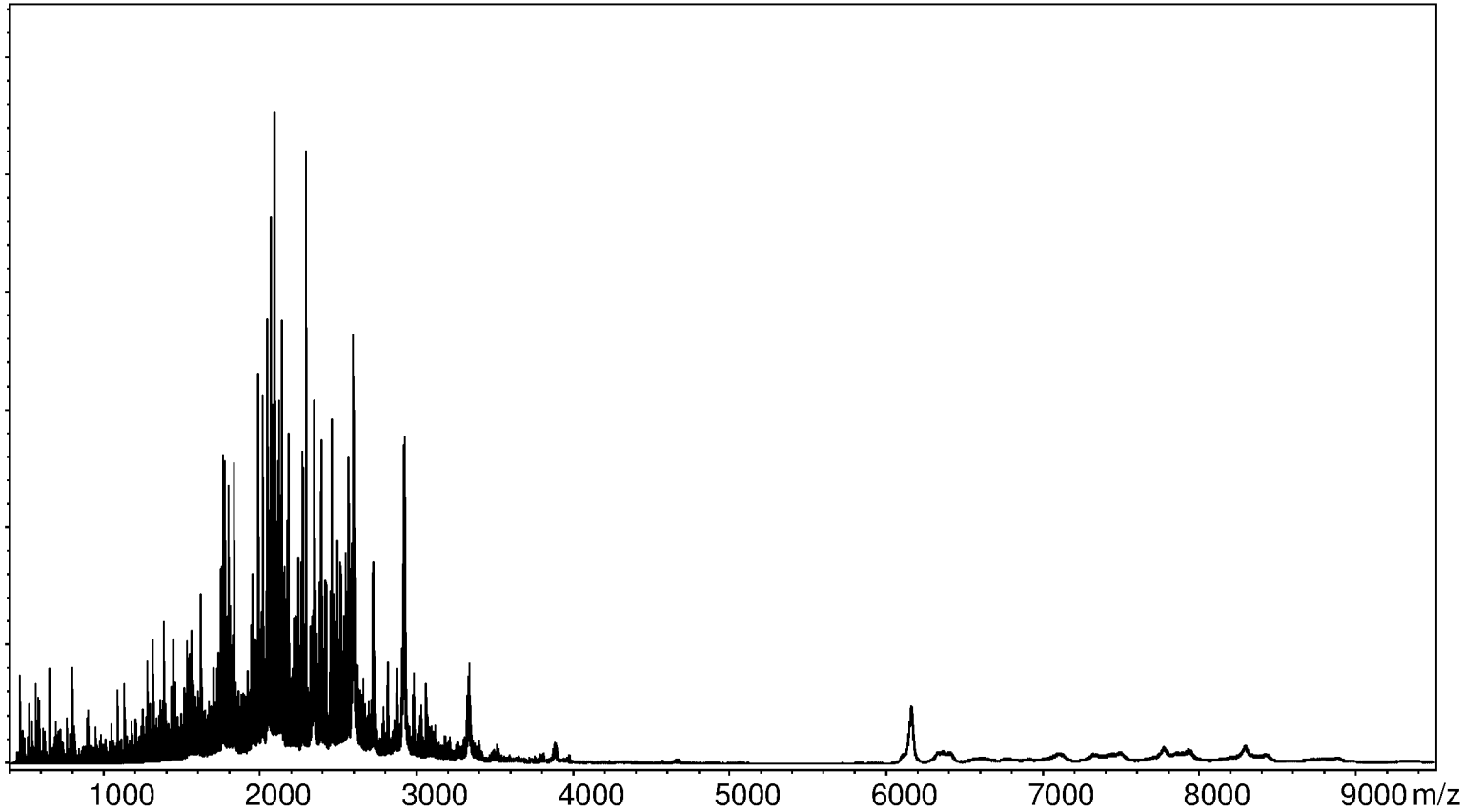
FIGS. 5A-5C depict the mass spectrum of the fragment ions generated with an acceleration voltage of 208 volts.
Figure 5B:
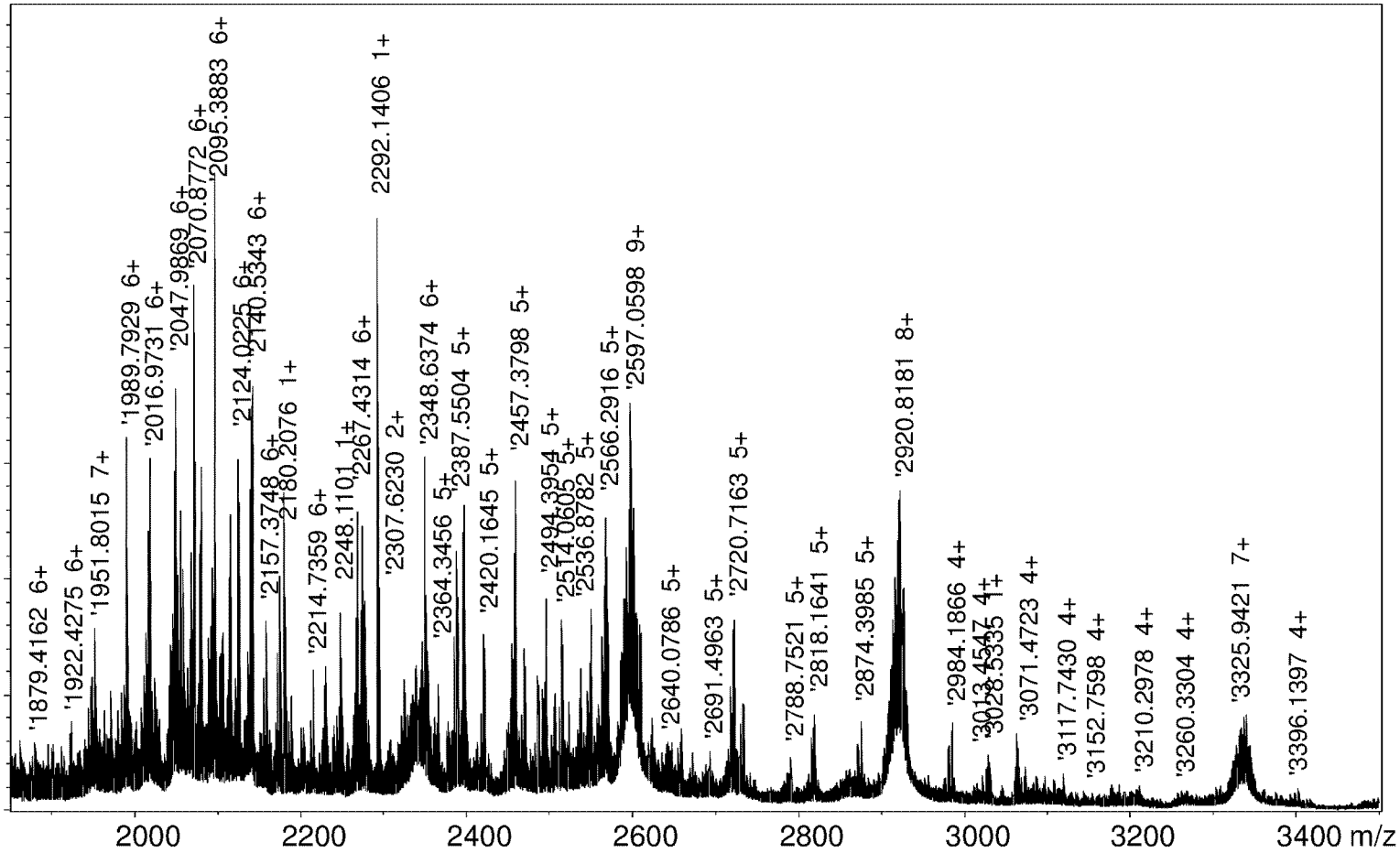
Figure 5C:
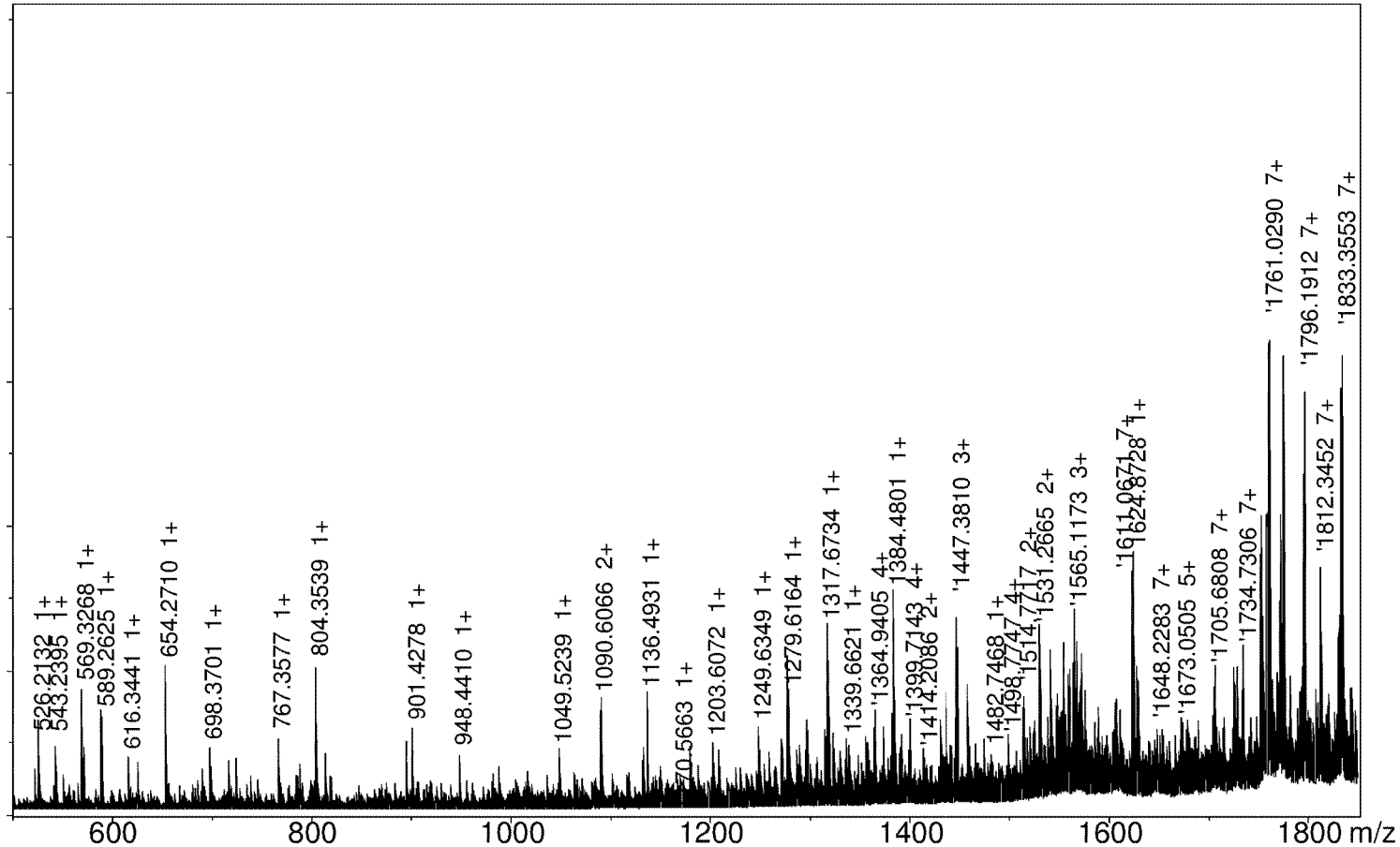

FIG. 3 shows the fragmentation spectra obtained with injection accelerations of 108 to 188 volts and pressure settings of approximately 2.4 pascal ($SF_6$) and 0.8 pascal ($N_2$) in each case. FIGS. 4 and 5 show the spectra in greater detail; for the mass spectrum of the fragment ions in FIG. 5, the ions were injected at 208 volts. It is noted here that these injection accelerations are much greater than usual; in the normal case, injections are carried out at accelerations of 50 to 80 volts. The high injection acceleration is necessary due to the fact that the intact molecular (complex) ions contain many fewer protons, and therefore the injection energy per mass unit, which is a function solely of the number of surplus charges, is much lower.

In the fragmentation spectra in FIGS. 3, 4, 5 signals which may be associated with the parent ions are clearly separate from signals of fragment ions. In the split fragment ions, the mass-to-charge ratio is much lower; i.e., the fragments are more highly protonated. In the customary ESI process, signals of the fragment ion and the parent ion may overlap, and fragment ions may not be detectable. This represents a further advantage of the native electrospraying.

Figure 6:
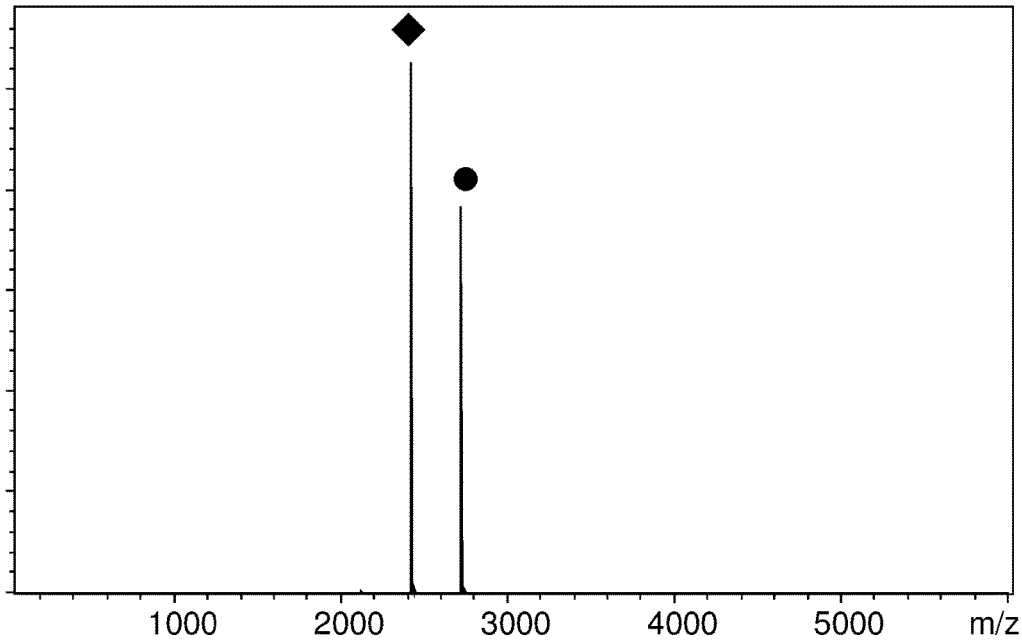
FIG. 6 shows a daughter ion spectrum, collision-fragmented by pure nitrogen, of the singly charged ions of a phosphazene heterodimer of the parent monoisotopic mass m/z=5159.8215 Da, having the empirical formula $[(C_{48}H_{18}F_{84}N_3O_6P_3)(C_{54}H_{18}F_{96}N_3O_6P_3)(NH_4)]^+$. The dimer is noncovalently bridged via an ammonium. The injection of the ions into the collision cell has taken place at an acceleration of approximately 200 V. Only the two phosphazene monomers are formed here, and are denoted by a circle and a diamond, respectively.

A further example could be a compound in which two different phosphazenes are noncovalently bonded via an ammonia molecule. The monoisotopic molecular mass of the ions of this molecular complex is m/z=5159.8215 Da; the empirical formula is $[(C_{48}H_{18}F_{84}N_3O_6P_3)(C_{54}H_{18}F_{96}N_3O_6P_3)(NH^4)]^+$. FIG. 6 shows the daughter ion spectrum of this phosphazene heterodimer collision-fragmented in pure nitrogen. The injection into the collision cell was carried out at an acceleration of approximately 200 V, which on the basis of the charge number z=1 corresponds to a kinetic energy of 200 eV. Only the phosphazene monomers are formed here, as denoted by a circle and a diamond, respectively.

Figure 7:
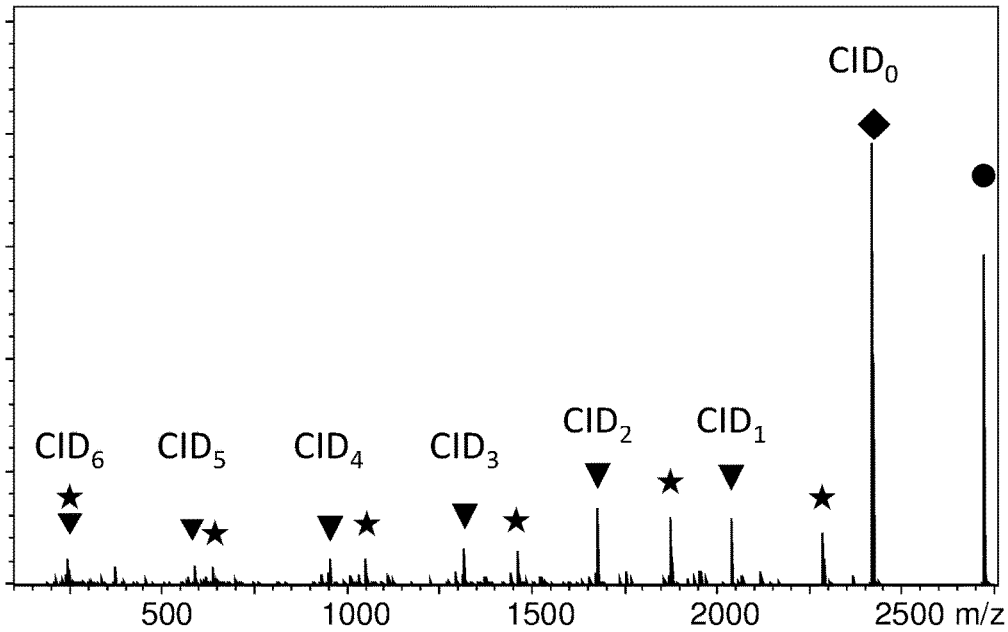
FIG. 7 depicts the collision-induced daughter ion spectrum of the phosphazene heterodimer as shown in FIG. 6, except that here the collision cell has been filled with a collision gas mixture composed of nitrogen and sulfur hexafluoride. The ions have been injected into the quadrupole collision cell at an acceleration of approximately 200 volts. The phosphazene monomers primarily formed are denoted by a diamond $(C_{48}H_{18}F_{84}N_3O_6P_3)^+$ and a circle $(C_{54}H_{18}F_{96}N_3O_6P_3)^+$, respectively. Fragmentation products of the particular phosphazene monomers are denoted by a triangle for the monomer $(C_{48}H_{18}F_{84}N_3O_6P_3)$ and by an asterisk for the monomer $(C_{54}H_{18}F_{96}N_3O_6P_3)$, respectively.
Figure 8:
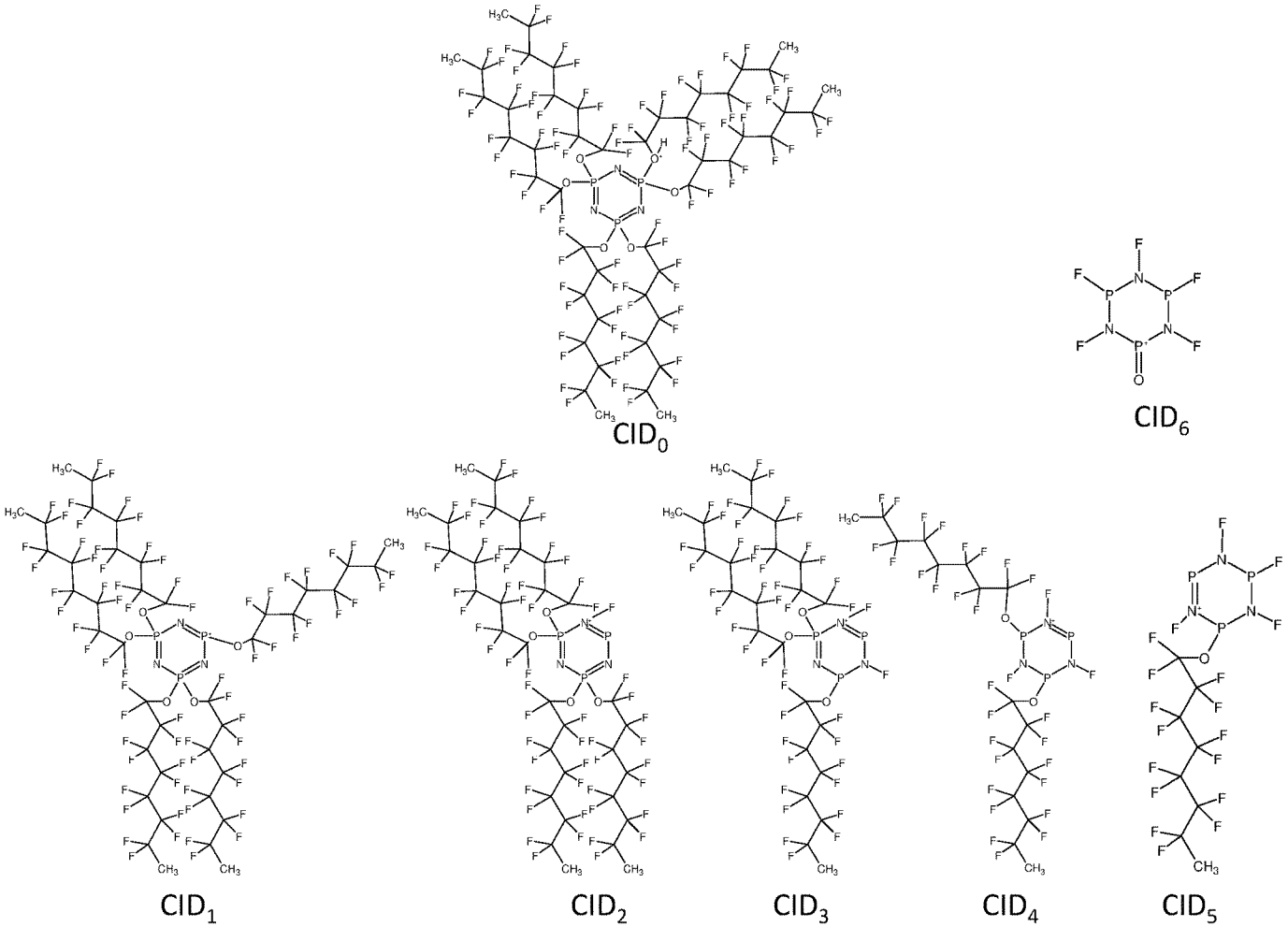
FIG. 8 shows proposed structures for the fragments resulting from the collision-induced excitations of the phosphazene heterodimer.

According to the invention, fragment ions of the monomers may be obtained by collisions with a mixture of a light collision gas and a heavy collision gas, in this case nitrogen and sulfur hexafluoride. FIG. 7 depicts the collision-induced daughter ion spectrum of the phosphazene heterodimer, using this mixture. The ions were injected at an acceleration of approximately 200 volts into the quadrupole collision cell used here. The phosphazene monomers primarily formed are denoted by a diamond $(C_{48}H_{18}F_{84}N_3O_6P_3)^+$ and a circle $(C_{54}H_{18}F_{96}N_3O_6P_3)^+$, respectively. Fragmentation products of the respective phosphazene monomers are denoted by a triangle for the monomer $(C_{48}H_{18}F_{84}N_3O_6P_3)$ and by an asterisk for the monomer $(C_{54}H_{18}F_{96}N_3O_6P_3)$, respectively. The structure of the molecular complex may be derived from this mass spectrum of the fragment ions; FIG. 8 shows proposed structures for the fragments resulting from the collision-induced excitation of the phosphazene heterodimer.

The power of the proposed method is apparent here. If the collision gas contained only a light component such as molecular nitrogen, hardly any fragment ions would result at the collision energy used, for example 200 V, so that structural elucidation would be difficult or impossible for want of sufficient data. If only a single heavy collision gas such as sulfur hexafluoride were used, the fragmentation efficiency would be increased, but the yield of available ions that reached the mass analyzer would in most cases be too low to obtain any detectable mass signals, which are required for structural elucidation. In contrast, use of the collision gas mixture remedies both problems. With an appropriately adapted injection energy, the heavy collision gas ensures efficient fragmentation of the molecular (complex) ions, whereas the portion of light collision gas ensures effective focusing of all ions in the proximity of the axis so that any remaining parent ions together with the fragment ions may be conducted to the mass analyzer in sufficient numbers.

The methods according to the invention are preferably carried out in mass spectrometers equipped with an electrospray ion source, a quadrupole mass filter for selecting parent ions, a linear radio frequency quadrupole collision cell, and a time-of-flight mass spectrometer with orthogonal ion injection (OTOF). FIG. 1 shows the schematic of such a mass spectrometer. It is particularly advantageous when the collision cell is provided with a device with which the ions may be ejected in the axial direction toward the OTOF pulser. Such devices are known to those skilled in the art, and therefore need no further explanation. The electrospray ion source may have various embodiments; nanospray ion sources, of which there are numerous embodiments, are particularly suited for producing molecular complex ions having intact structure.

Other high-resolution mass analyzers may be used instead of the time-of-flight analyzer, such as ion cyclotron resonance (ICR) analyzers, or mass analyzers based on Kingdon ion traps, such as the known Orbitrap® (Thermo Fischer Scientific).

In summary, the invention proposes a method for the structural elucidation of heavy molecular ions, in particular heavy molecular complex ions, having charge-related masses m/z of greater than 2000 daltons in customary linear radio frequency multipole collision cells, characterized in that a collisionally induced fragmentation is carried out in a linear collision cell in a mixture of at least one light collision gas and at least one heavy collision gas, with heavy collision gases having a molecular mass of at least approximately 80 daltons, and light collision gases having a molecular mass of approximately 40 daltons at most. The collision gases should be present in the collision cell with partial pressures of 0.01 to 10 pascals. The collision gases may have approximately the same partial pressure, but for many molecular (complex) ions the partial pressure of the light collision gas may be lower than the partial pressure of the heavy collision gas. For weakly bonded molecular complexes, it may be advantageous for the partial pressure of the heavy collision gas to be slightly lower than that of the light collision gas.

The molecular (complex) ions are preferably injected into the collision cell at acceleration voltages between 100 and 300 volts, or in other words, with a kinetic energy between approximately 100 and 300 electronvolts per surplus charge.

When the molecules and molecular complexes originate from a biological environment, for structural analyses it may be expedient to produce the molecular (complex) ions in such a way that they maintain the intact (native) structure which the molecules and molecular complexes have in their natural environment. For this purpose, the molecular (complex) ions may be produced in electrospray ion sources, in which they are sprayed in pure aqueous solution without addition of organic solvents. A detergent, i.e., a surface-active substance which reduces the surface tension, may optionally be added to the aqueous solution.

For operating the mass spectrometer with the time-of-flight mass analyzer, it is advantageous for the linear collision cell to have a device with which the ions may be axially ejected from the cell. For example, a direct voltage gradient may be generated which extracts the remaining and/or dissociated ions from the collision cell. Instead of the mass analyzer according to the time-of-flight principle, mass analyzers according to the principle of ion cyclotron resonance or the principle of Kingdon ion traps may be used.

The molecular complex ions may be formed, for example, from antibodies, optionally with antibody drug conjugate (ADC), naturally occurring soluble membrane proteins, or other noncovalently bonded protein complexes.

The invention has been described above with reference to a number of different embodiments thereof. It will be understood, however, that various aspects or details of the invention can be modified without deviating from the scope of the invention. In particular, measures disclosed in connection with different embodiments can be combined as desired if this appears feasible to a person skilled in the art. In addition, the above description serves only as an illustration of the invention and not as a limitation of the scope of protection, which is exclusively defined by the enclosed Claims, taking into account any equivalents which may possibly exist.

The invention claimed is:

1. A method for the structural elucidation of pluralities of heavy molecular ions and molecular complex ions, each having a charge-related mass m/z of greater than 2000 daltons, in a linear radio frequency multipole collision cell which has an arrangement of a plurality of elongated electrodes situated in parallel to one another about a common axis, wherein all of the elongated electrodes of the collision cell together encompass a rotational symmetry about the common axis larger than twofold, comprising:

accelerating the heavy molecular ions and molecular complex ions, which include multiply charged ions, to a predetermined kinetic energy of approximately 100 to 300 electron volts per surplus charge using acceleration voltages and axially injecting them into the linear collision cell, carrying out collisionally induced fragmentation without a DC potential enveloping the linear radio frequency multipole collision cell, brought about substantially by the predetermined kinetic energy of the axial injection, in the linear collision cell in a mixture of a light collision gas and a heavy collision gas, wherein the heavy collision gas has a molecular mass of at least approximately 80 daltons, and the light collision gas has a molecular mass of approximately 40 daltons at most, and conducting any heavy molecular ions and molecular complex ions remaining from the pluralities of heavy molecular ions and molecular complex ions after the collisionally induced fragmentation, as well as fragment ions resulting from the collisionally induced fragmentation, out of the linear collision cell to a mass analyzer.

2. The method according to claim 1, wherein the collision gases in the linear collision cell have partial pressures between about 0.01 and 10 pascal.

3. The method according to claim 1, wherein the collision gases in the linear collision cell have approximately the same partial pressure.

4. The method according to claim 1, wherein the partial pressure of the heavy collision gas in the linear collision cell is lower than the partial pressure of the light collision gas.

5. The method according to claim 1, wherein the partial pressure of the light collision gas in the linear collision cell is lower than the partial pressure of the heavy collision gas.

6. The method according to claim 1, wherein the molecular ions and molecular complex ions are injected into the collision cell at acceleration voltages between about 100 and 300 volts.

7. The method according to claim 1, wherein the molecules and molecular complexes originate from a biological environment, and the molecular ions and molecular complex ions are produced in such a way that they maintain an intact structure.

8. The method according to claim 7, wherein the molecular ions and molecular complex ions are produced in electrospray ion sources, where they are sprayed in pure aqueous solution, using a pH-neutral buffer without addition of organic solvents.

9. The method according to claim 7, wherein the intact structure is a native structure which the molecules and molecular complexes have in their natural environment.

10. The method according to claim 1, wherein the linear collision cell has a device with which the ions may be axially ejected from the cell in order to be conducted to the mass analyzer.

11. The method according to claim 1, wherein the mass analyzer operates according to one of the time-of-flight principle, the principle of ion cyclotron resonance, and the principle of Kingdon ion traps.

12. The method according to claim 1, wherein the molecular ions and molecular complex ions are formed from antibodies or antibody drug conjugates.

13. The method according to claim 1, wherein the molecular ions and molecular complex ions are formed from soluble membrane proteins.

14. The method according to claim 1, wherein the molecular ions and molecular complex ions are formed from noncovalently bonded protein complexes.

15. The method according to claim 1, wherein the linear collision cell is a quadrupole collision cell.

16. The method according to claim 1, wherein the collision cell is linear in that the elongated electrodes have an axial length that is a multiple of a diameter through the common axis between opposite elongated electrode pairs.

* * * * *